US005498847A

United States Patent [19]

Bennett et al.

[11] Patent Number: 5,498,847

[45] Date of Patent: Mar. 12, 1996

[54] ARC STACK FOR A CIRCUIT BREAKER

[75] Inventors: Dale W. Bennett, Cedar Rapids, Iowa; James V. Fixemer, Denton, Nebr.; Teresa I. Hood, Coralville, Iowa; Randall L. Siebels, Cedar Rapids, Iowa; Douglas Van Waart, Anomosa, Iowa

[73] Assignee: Square D Company, Palatine, Ill.

[21] Appl. No.: 181,288

[22] Filed: Jan. 13, 1994

[51] Int. Cl.[6] ..... H01H 33/08

[52] U.S. Cl. ..... 218/81; 218/34; 218/15

[58] Field of Search ..... 200/144 R, 144 C, 200/147 R, 147 A, 147 B, 148 R, 148 C; 218/1, 2, 8, 15, 22, 34, 35, 36, 37, 38, 39, 43, 46, 47, 81, 103, 155, 156

[56] References Cited

U.S. PATENT DOCUMENTS

| | | | |
|---|---|---|---|
| 1,963,643 | 6/1934 | Brainard et al. | 200/144 |
| 2,652,469 | 9/1953 | Weston | 200/144 |
| 2,671,146 | 3/1954 | Driver | 200/148 |
| 3,943,316 | 3/1976 | Oster | 200/337 |
| 3,943,472 | 3/1976 | Oster et al. | 335/16 |
| 3,944,953 | 3/1976 | Oster | 335/23 |
| 3,946,346 | 3/1976 | Oster et al. | 335/16 |
| 4,740,768 | 4/1988 | Morris et al. | 335/22 |
| 4,876,421 | 10/1989 | Miller et al. | 200/144 C |
| 4,970,482 | 11/1990 | Jacobs et al. | 335/201 |
| 5,003,137 | 3/1991 | Tateishi et al. | 200/144 R |
| 5,003,139 | 3/1991 | Edds et al. | 200/401 |
| 5,075,657 | 12/1991 | Rezac et al. | 335/6 |
| 5,097,589 | 3/1992 | Rezac et al. | 29/622 |
| 5,159,304 | 10/1992 | Yamagata et al. | 335/202 |
| 5,245,302 | 9/1993 | Brune et al. | 335/35 |

FOREIGN PATENT DOCUMENTS

| | | | |
|---|---|---|---|
| 1573589 | 7/1969 | France | H01H 9/37 |
| 2269191 | 11/1975 | France | H01H 73/18 |
| 1020396 | 5/1958 | Germany . | |
| 615025 | 12/1948 | United Kingdom | H01H 9/34 |

*Primary Examiner*—Kristine L. Kincaid
*Assistant Examiner*—Michael A. Friedhofer
*Attorney, Agent, or Firm*—Larry I. Golden; Kareem M. Irfan

[57] ABSTRACT

An arc stack for receiving a circuit breaker blade moveable between a closed position and an open position, includes a plurality of generally rectangular are plates having substantially similar length and width dimensions and positioned substantially parallel to one another. The straight edges of the arc plates are in line with one another so that the are stack is generally rectangular in shape. The arc plates have respective arc throats formed therein having a plurality of sizes so as to form a longitudinal passageway extending through the arc throats following the arc generated by the blade moving between the closed and open positions. The arc plates include sets of arc plates with the arc plates in each set having identical arc throats. The sets of arc plates are arranged in order of decreasing arc throat size with the set having the largest arc throats being positioned adjacent the circuit breaker blade in the closed position. The arc stack is formed in two sections with each section including a selected number of arc plates. The arc plates in each section are interconnected by a pair of side fibers engaging associated edges of the arc plates. The two sections are connected to form the arc stack by engaging the inner edges of the pair of side fibers of one section with mating inner edges of the pair of side fibers of the other section.

16 Claims, 4 Drawing Sheets

PRIOR ART

ARC STACK FOR A CIRCUIT BREAKER

FIELD OF THE INVENTION

The present invention relates generally to circuit breakers and, more particularly, to an arc stack for a circuit breaker.

BACKGROUND OF THE INVENTION

Arc stacks receive, develop arc voltage and absorb energy launched via a moveable circuit breaker blade as it moves from a closed position to an open position. One type of arc stack, designated in FIG. 1 as reference numeral 100, includes a plurality of identical, generally rectangular plates positioned and interconnected parallel to one another. The plates have respective identically-shaped arc throats to form a passageway for the moveable blade. To maximize performance of the arc stack, the passageway formed by interconnecting the plates with the respective individual arc throats follows the radius of the moveable blade as it opens. This is accomplished by laterally offsetting the identical arc plates relative to one another in the same direction so that the individual arc throats follow the radius of the moveable blade. Thus, the arc stack takes on an elongated curved shape.

A drawback of this type of are stack is that it is difficult to manufacture with automated equipment because its construction requires complex manipulation of the circuit breaker components surrounding the arc stack.

Another drawback of this type of arc stack is that it takes up a significant amount of space within the circuit breaker enclosure. Referring to the arc stack of FIG. 1, for example, due to the irregular shape of the arc stack, it occupies an unnecessarily large volume within the enclosure.

Moreover, there is an ongoing effort to reduce the cost and size of circuit breakers while reducing the labor required to assemble and maintain the circuit breakers.

SUMMARY OF THE INVENTION

The present invention provides an arc stack which can be assembled in a relatively compact area within a circuit breaker enclosure.

The present invention also provides an arc stack which is easily manufactured using automated equipment.

The present invention further provides an arc stack which promotes enhanced interruption performance for the associated circuit breaker.

The present invention also provides an arc stack construction which is cost-effective and easy to manufacture.

In one particular embodiment, the foregoing objects are realized by providing an arc stack for receiving a circuit breaker blade moveable between a closed position and an open position, comprising a plurality of arc plates positioned substantially parallel to one another. The arc plates have respective arc throats therein having a plurality of sizes so as to form a passageway extending through the arc throats following the arc generated by the blade moving between the closed and open positions. A connecting support is used to maintain the arc plates substantially parallel to one another.

The above summary of the present invention is not intended to represent each embodiment, or every aspect, of the present invention. This is the purpose of the figures and the detailed description which follow.

BRIEF DESCRIPTION OF THE DRAWINGS

Other objects and advantages of the invention will become apparent upon reading the following detailed description and upon reference to the drawings in which.

Figure 1:
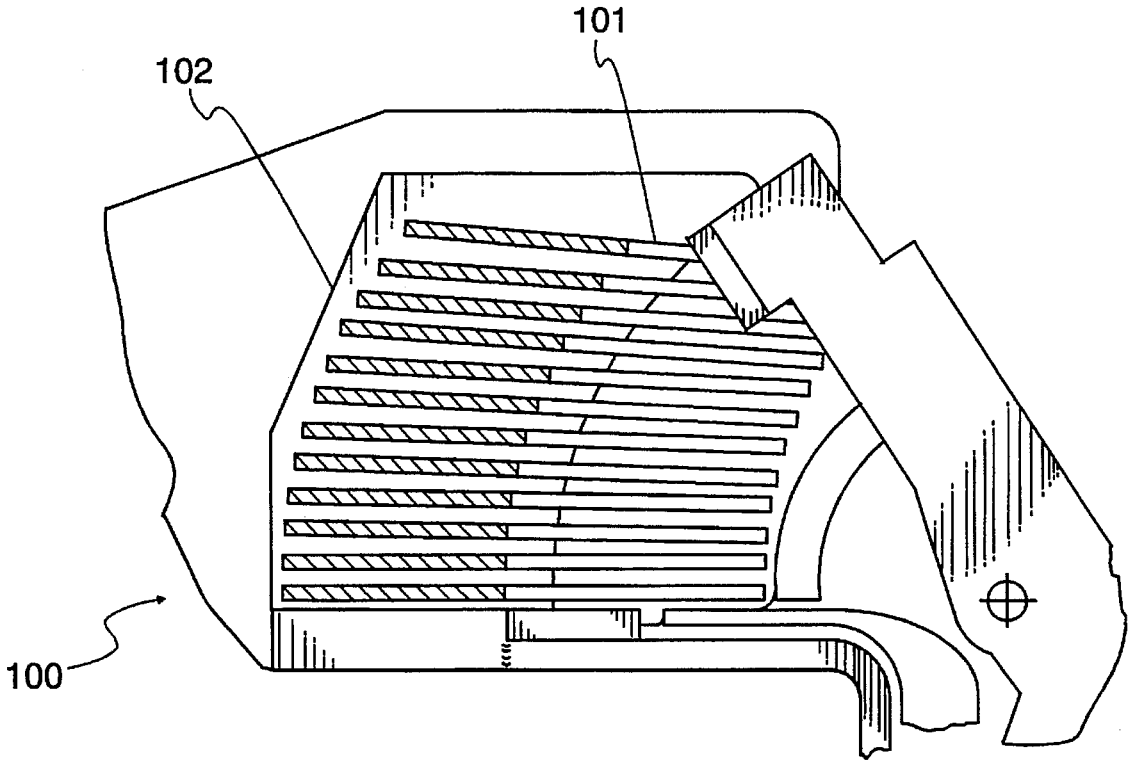
FIG. 1 is a side view of one type of prior art arc stack.

While the invention is susceptible to various modifications and alternative forms, specific embodiments thereof have been shown by way of example in the drawings and will be described in detail. It should be understood, however, that it is not intended to limit the invention to the particular form described. On the contrary, the intention is to cover all modifications, equivalents, and alternatives falling within the spirit and scope of the invention as defined by the appended claims.

DETAILED DESCRIPTION OF THE PREFERRED EMBODIMENT

Turning now to the drawings, the present invention is discussed in the context of an exemplary double-break circuit breaker using an arc stack embodying the principles of the present invention. The particular circuit breaker illustrated and described (FIG. 2) should not, however, be construed to limit the possible applications for the present invention, as these applications encompass a wide variety of circuit breaker types. To fully appreciate the utility of the present invention, however, the double-break circuit breaker of FIG. 2 will first be described, followed by a detailed description of a secondary arc stack 10 (in accordance with the present invention) generally depicted in the circuit breaker of FIG. 2.

Figure 2:
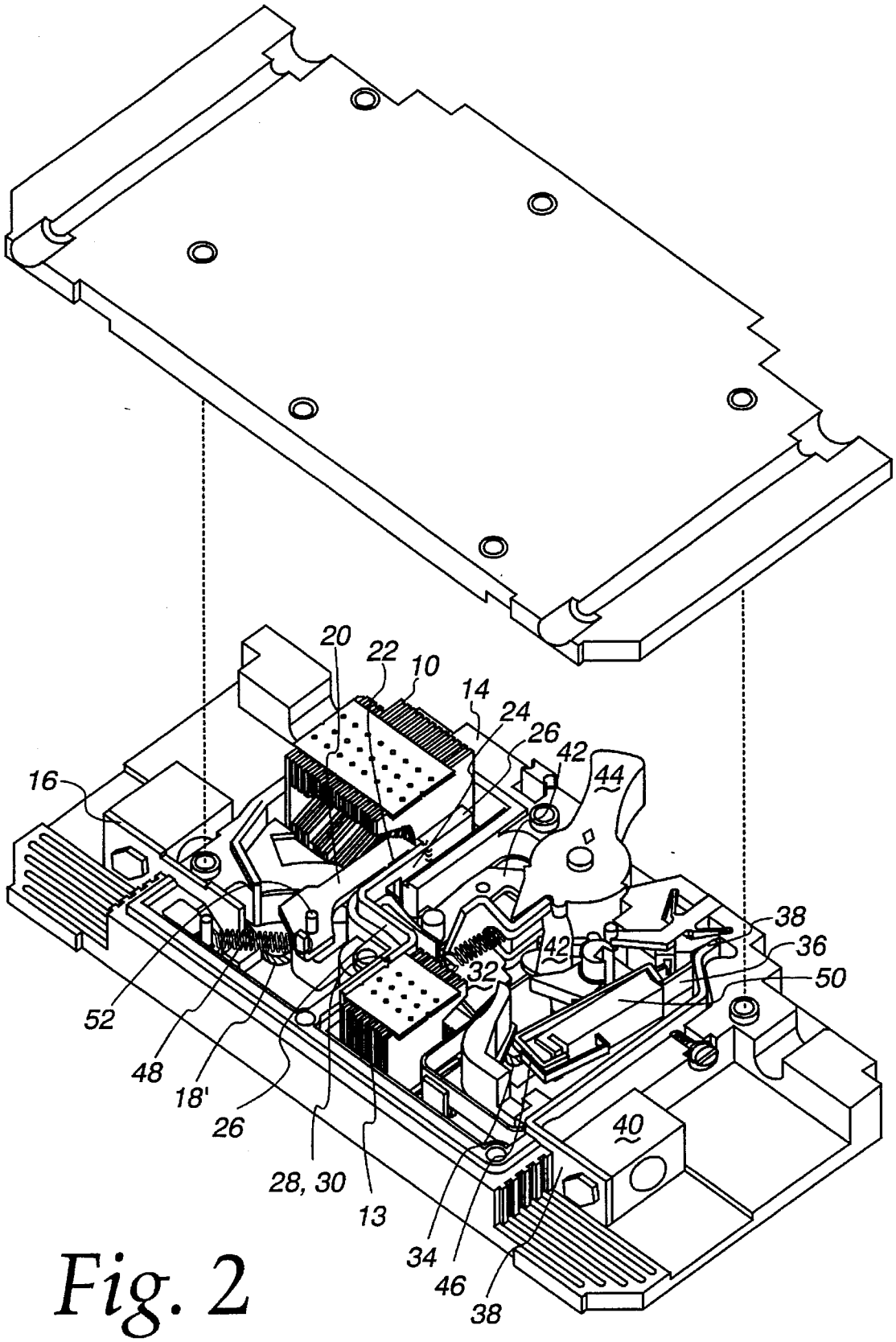
FIG. 2 is a side view of a double-break circuit breaker including an arc stack embodying the present invention.

The circuit breaker of FIG. 2 includes a circuit breaker base 14 which carries all of the internal components of the circuit breaker. The current path through the circuit breaker begins at a line terminal 16, and from the line terminal 16 the current path goes through a flexible pigtail 18. The flexible pigtail 18 is attached to a secondary blade 20 with a moveable contact 22 mating with a stationary contact 24. Current flows through the moveable and stationary contacts 22, 24 to the mid terminal 26, which is configured in an S form. The other side of the mid terminal 26 includes another stationary contact 28 connected thereto. Positioned opposite the stationary contact 28 is a mating moveable contact 30 attached to a primary blade 32. Current flows through the stationary and moveable contacts 28, 30, through the primary blade 32, and into one end of a primary flexible connector or pigtail 34. The other end of the primary flexible connector 34 is attached to a bimetal 36, which provides the thermal tripping characteristics for the circuit breaker. Finally, the current flows from the bimetal 36 through a load terminal 38 and out of the load end of the circuit breaker via a lug 40.

The primary section of the circuit breaker includes the primary blade 32, a trip lever 42, a handle 44, a magnetic armature 46, a pigtail 34, and a primary are stack 13. The secondary section includes the secondary blade 20, the pigtail 18, an extension spring 48, and the secondary arc stack 10. In the illustrated circuit breaker, using conventional magnetic and thermal trip protection features, the primary section provides the breaking capacity for all levels of current from one ampere to approximately 3000 amperes without operational assistance from the secondary section. The magnetic armature 46 is drawn to a yoke 50 during high current flow. This allows the trip lever 42 to disengage from the magnetic armature 46 and rotate to the trip position, which, in turn, allows the primary blade contact 30 to separate from the stationary contact 28 to break the current flow. As the contacts 28, 30 are separated, an arc voltage is generated in the primary arc stack 13. A thermal trip via the bimetal 36 results in the same sequence of events and, additionally, results in the trip lever 42 disengaging from the magnetic armature 46.

The normal ON and OFF operation of the primary blade 32 occurs in response to rotation of the handle 44 in a clockwise or counterclockwise motion. In response to rotation of the handle 44 in either direction, the primary blade 32 either opens or closes the circuit via the primary moveable contact 30 and the primary stationary contact 28. Rotation of the primary blade 32 is tied directly to the handle 44 for the normal ON and OFF operation of the primary blade 32. Furthermore, the secondary section is not affected by the normal ON and OFF operation of the primary blade 32. The secondary blade contact 22 and the secondary stationary contact 24 remain closed.

As previously explained, the secondary section of the circuit breaker has limited operation below 3000 amperes of fault current. However, at current levels above 3000 amperes, the secondary section begins to contribute to interruption performance. In particular, the secondary blade 20 derives contact force from the extension spring 48. The secondary blade 20 pivots about the blade pivot 52 with the extension spring 48 extended as the secondary blade 20 opens up in response to a current fault above 3000 amperes. There is no linkage of the secondary blade 20 to the primary blade 32, but rather the operation of the secondary and primary blades 20, 32 is totally separate and independent.

In response to the occurrence of a current fault above 3000 amperes, the constriction resistance of the secondary blade contact 22 and the secondary stationary contact 24 provides a magnetic force that tries to separate the contacts. Simultaneously, the current path configuration of the mid terminal 26 and the secondary blade 20 forms a magnetic blowoff loop which also tries to separate the contacts 22, 24. The addition of both of these opening forces to the secondary blade 20 causes the secondary blade 20 to separate at the contacts 22, 24. As the secondary blade 20 opens, the extension spring 48 begins to stretch. The extension spring 48 permits the secondary blade 20 to continue to open as long as the force to open the blade is greater than the extension force of the spring 48. As the contacts 22, 24 are separated, an arc voltage is generated in the secondary arc stack 10. The combination of the arc voltage generated by the secondary arc stack 10 and the arc voltage generated by the primary arc stack 13 make these voltages add together. This allows a very fast rise of arc voltage and also allows high levels of arc voltage consistent with double-break circuit breakers.

As the current fault level rises significantly above 3000 amperes, the faster and higher the secondary blade 20 will be moved. As the interruption takes place and the electric arc is extinguished in the primary and secondary sections, the secondary blade 20 is biased to return to the closed position because of the bias from the extension spring 48. The primary blade remains in the open or tripped position. At this point, the interruption of the current fault is complete with no opportunity to reestablish itself.

For further information regarding the overall construction and operation of the circuit breaker shown in FIG. 2, reference may be made to U.S. patent application No. 08/181,289, entitled "Circuit Breaker Having Double Break Mechanism", filed concurrently herewith, assigned to the instant assignee and incorporated herein by reference.

Figure 3:
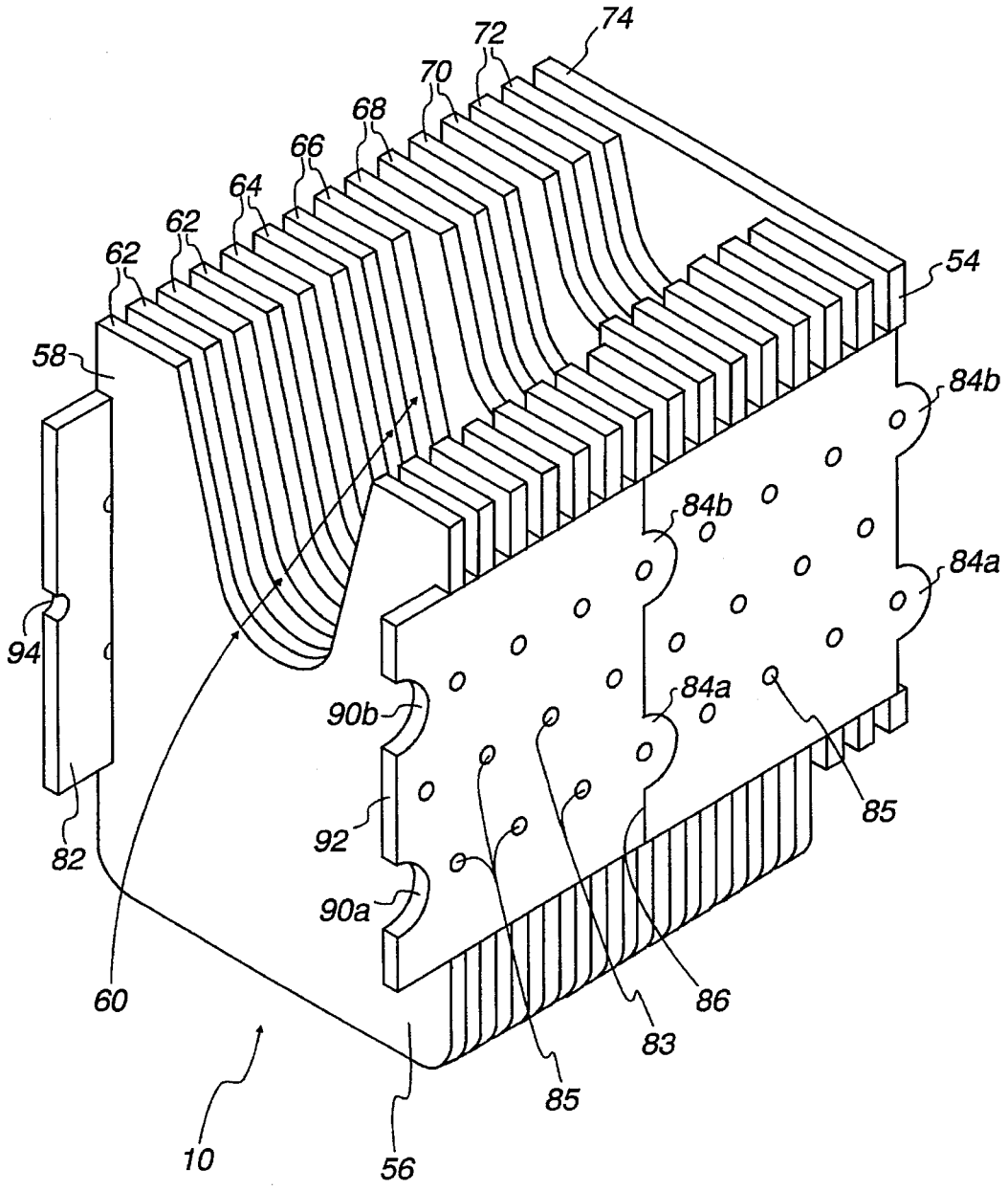
FIG. 3 is a perspective view of the arc stack of FIG. 2, according to the present invention.
Figure 4:
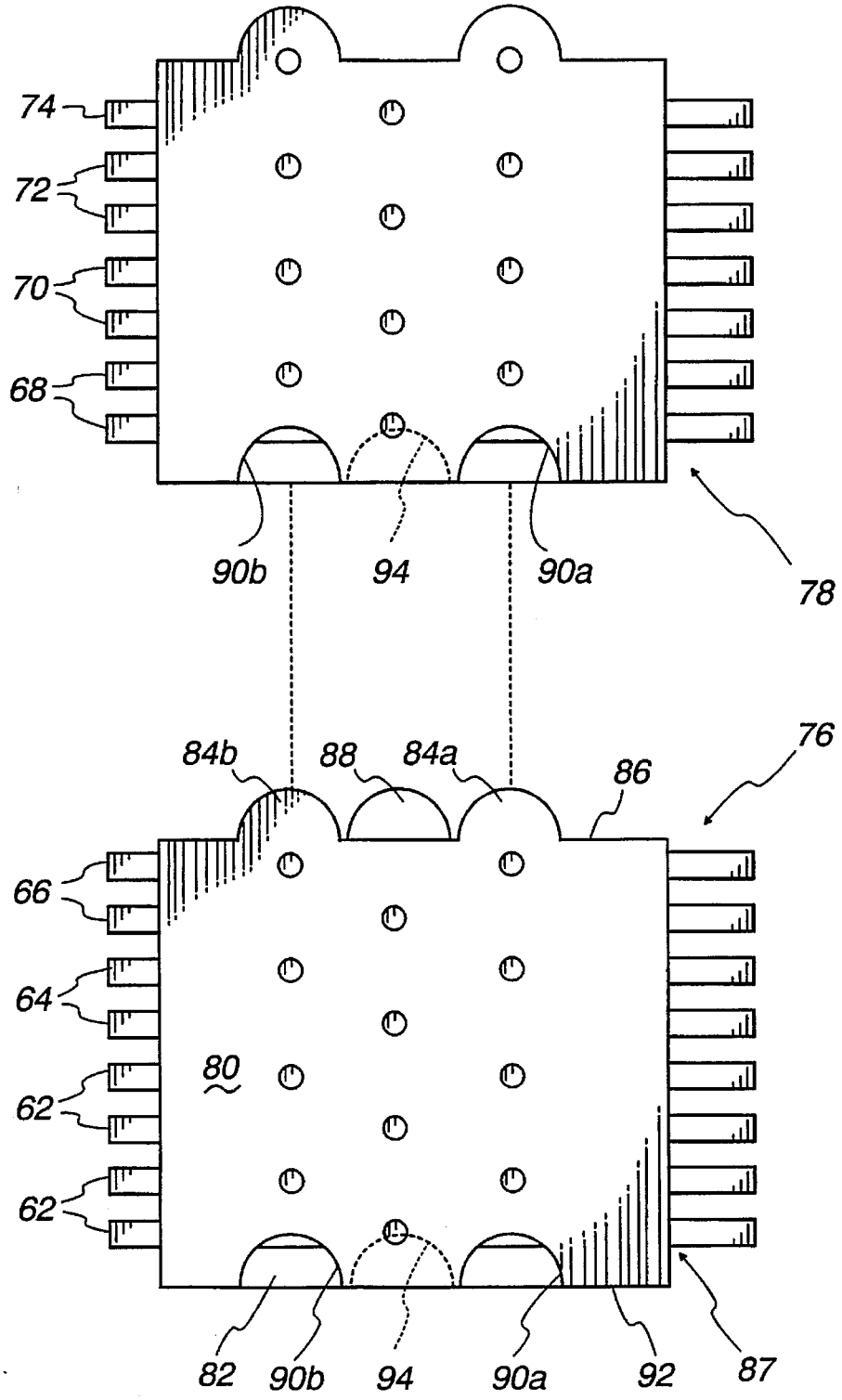
FIG. 4 is a side view of two assemblies which can be combined to form the arc stack in FIG. 3.

FIGS. 3 and 4 illustrate the secondary arc stack 10 which is used in the exemplary circuit breaker of FIG. 1. The secondary arc stack 10 is z-axis assembled into the base 14 of the circuit breaker in FIG. 2. More specifically, the secondary arc stack 10 is placed into the base 14 with the bottom surface 54 abutting the bottom of the base 14 and the side 56 positioned adjacent and substantially parallel to one end of the mid terminal 26. In the assembled form of the circuit breaker, the secondary blade 20 extends into the arc stack side 58 having a longitudinal passageway 60 formed therein.

The secondary arc stack 10 is generally rectangular in shape and is formed by interconnecting a series of individual arc plates 62, 64, 66, 68, 70, 72, and 74. Except for the end are plate 74, the individual arc plates have respective individual arc throats formed therein by means such as metal stamping. The longitudinal passageway 60 created by the individual arc throats follows the arc that the secondary blade 20 generates about the blade pivot 52. The four arc plates closest to the mid terminal 26 are identical and are labelled by the reference numeral 62. Adjacent to the four arc plates 62 are two identical arc plates 64 having an arc throat shorter than the arc throat of the arc plates 62. Similarly, the arc throat of the two identical arc plates 66 is shorter than the arc throat of the two identical arc plates 64, the arc throat of the two identical arc plates 68 is shorter than that of the two arc plates 66, the arc throat of the two identical arc plates 70 is shorter than that of the two arc plates 68, the arc throat of the two identical arc plates 72 is shorter than that of the two arc plates 70, and the end arc plate 74 has no arc throat. The foregoing progression of different plate profiles follows the arc of the secondary blade 20 about the blade pivot 52.

An advantage of forming the secondary arc stack 10 from arc plates having a progression of arc throat profiles matching the arcing radius of the secondary blade 20 is that the arc stack 10 is compact, taking up a minimal amount of space. Furthermore, this progression of arc throat profiles permits the secondary arc stack 10 to be easily manufactured with automated equipment and to promote enhanced interruption performance. Manufacturing the secondary arc stack 10 with automated equipment, in turn, lowers the cost of manufacturing the secondary arc stack 10.

Referring to FIGS. 3 and 4, the secondary arc stack 10 is assembled from a lower section 76 and an upper section 78. The lower section 76 of the secondary arc stack 10 includes eight are plates 62, 64, and 66 held together by top and bottom side fibers 80, 82. The side fibers 80, 82 include positioning holes 83 which receive respective protrusions 85 extending from the respective upper and lower edges of the arc plates 62, 64, and 66. Furthermore, the side fibers 80, 82 are positioned within respective rectangular slots 87 extending from the outermost arc plate 62 to the innermost are plate 66 and formed from individual slots in the respective upper and lower edges of all the arc plates 62, 64, and 66. The rectangular slots 87 and the mating holes 83 and protrusions 85 promote a firm engagement between the side fibers 80, 82 and the arc plates 62, 64, and 66, and retain the arc plates together as an assembly.

The top side fiber 80 has a different profile than the bottom side fiber 82. In particular, the top side fiber 80 has two male nubs 84*a* and 84*b* protruding from the connecting edge 86, while the bottom side 82 only has one male nub 88 protruding from its connecting edge (FIG. 4). Also, the top side fiber 80 has two female nubs 90*a* and 90*b* formed in the outer edge 92, while the bottom side 82 only has one female nub 94 formed in its outer edge.

The upper section 78 of the secondary arc stack 10 has top and bottom side fibers with edge profiles identical to the edge profiles of the respective top and bottom side fibers 80, 82 of the lower section 76. Therefore, like parts are indicated by the same reference numerals. One difference between the lower section 76 and the upper section 78 of the arc stack 10 is that the lower section 76 includes one more arc plate than the upper section 78. The upper section 78 only includes the seven arc plates 68, 70, 72, and 74. Another difference, as previously stated, is that the seven arc plates 68, 70, 72, and 74 are configured with different arc throats than the arc plates 62, 64, and 66.

To connect the lower and upper sections 76, 78 together, the corresponding nubs along the connecting edges of the top and bottom side fibers on both the lower and upper sections 76, 78 are mated together. In particular, the male nubs 84*a*, 84*b* along the connecting edge 86 of the top side fiber 80 of the lower section 76 are engaged with the respective female nubs 90*a*, 90*b* along the connecting edge of the top side fiber of the upper section 78. Furthermore, the male nub 88 along the connecting edge of the bottom side fiber 82 of the lower section 76 is engaged with the corresponding female nub 94 along the connecting edge of the bottom side fiber of the upper section 78. As the lower and upper sections 76, 78 are brought together, they appear as a single secondary arc stack 10 as shown in FIG. 3 with all the arc plates fitting together.

Not only is the manufacturing cost for the secondary arc stack 10 lowered because it is produced by automated equipment, but the manufacturing cost is further lowered because it is produced from multi-sections, i.e., the lower section 76 and the upper section 78, instead of from just one section. Producing the secondary arc stack 10 in multi-sections reduces the cost of all the equipment required to handle the arc stack 10 because less capacity is needed to handle the multi-sections. Moreover, the stamping tonnage require to stamp out the arc plates is dramatically reduced in a multi-section assembly.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. An arc stack for receiving a circuit breaker blade moveable between a closed position and an open position, comprising:

a plurality of arc plates positioned substantially parallel to one another and forming a generally rectangular body, said plurality of arc plates being arranged in groups including one or more of said arc plates having substantially similar respective arc throats formed therein, said respective arc throats progressively decreasing in depth from group to group along the length of the arc stack in a direction extending away from the closed position of the blade so as to form a curved passageway extending through said arc throats following the radius of the blade moving between the closed and open positions, said arc throats extending inwardly from respective arc-throat forming edges of said arc plates, said respective arc-throat forming edges being substantially coplanar with each other; and a connecting support for maintaining said plurality of arc plates substantially parallel to one another.

2. The arc stack of claim 1, wherein said arc plates are generally rectangular in shape.

3. The arc stack of claim 1, wherein said plurality of arc plates includes at least seven sets of arc plates, the arc plates in each of said sets having substantially identically shaped are throats, said seven sets of are plates being arranged in order of decreasing arc throat size, the arc plates in each of said sets being positioned adjacent to one another.

4. An arc stack for receiving a circuit breaker blade moveable between a closed position and an Open position, comprising:

a plurality of arc plates positioned substantially parallel to one another, said plurality of arc plates having respective arc throats therein, said arc throats having a plurality of sizes so as to form a passageway extending through said arc throats following the arc generated by the blade moving between the closed and open positions, wherein said plurality of arc plates includes at least seven sets of arc plates, the arc plates in each of said sets having substantially identically shaved arc throats, said seven sets of arc plates being arranged in order of decreasing arc throat size, the arc plates in each of said sets being positioned adjacent to one another, wherein the arc plates in one of said sets have a different arc throat size than the arc plates in each of the remaining sets; and a connecting support for maintaining said plurality of arc plates substantially parallel to one another.

5. The arc stack of claim 4, wherein said seven sets include two end sets positioned at opposite ends of the arc stack and five middle sets positioned between said two end sets, one of said two end sets having four arc plates and the other of said two end sets having one arc plate.

6. The arc stack of claim 5, wherein each of said five middle sets includes two arc plates.

7. The arc stack of claim 1, wherein said connecting support includes side fibers connected to opposing sides of the arc stack, each of said side fibers interconnecting associated edges of said arc plates.

8. The arc stack of claim 7, wherein side fibers include positioning holes and said associated edges of said arc plates include protrusions engaging said positioning holes in said side fibers.

9. An arc stack, comprising:

a first plurality of substantially parallel arc plates having respective arc throats formed therein;

a first connecting support for interconnecting said first plurality of are plates to form a first section;

a second plurality of substantially parallel arc plates having respective arc throats formed therein;

a second connecting support for interconnecting said second plurality of arc plates to form a second section; and interlocking members disposed on said first and second sections for connecting said first section to said second section.

10. The arc stack of claim 9, wherein said first connecting support includes a first pair of side fibers connected to opposing sides of said first section, each of said first pair of side fibers interconnecting associated edges of said first plurality of arc plates.

11. The arc stack of claim 10, wherein said second connecting support includes a second pair of side fibers connected to opposing sides of said second section, each of said second pair of side fibers interconnecting associated edges of said second plurality of arc plates.

12. The arc stack of claim 11, wherein said first pair of side fibers include positioning holes and said associated edges of said first plurality of arc plates include protrusions engaging said positioning holes in said first pair of side fibers.

13. The arc stack of claim 12, wherein said second pair of side fibers include positioning holes and said associated edges of said second plurality of arc plates include protrusions engaging said positioning holes in said second pair of side fibers.

14. The arc stack of claim 11, wherein said interlocking members include male nubs protruding from inner edges of said first pair of side fibers and mating female nubs disposed along opposing inner edges of said second pair of side fibers, said male nubs engaging said female nubs to connect said first section to said second section.

15. The arc stack of claim 14, wherein one of said first pair of side fibers includes two male nubs protruding from its inner edge and the other of said first pair of side fibers includes one male nub protruding from its inner edge, and wherein one of said second pair of side fibers includes two female nubs disposed along its inner edge and engaging said two male nubs and the other of said second pair of side fibers includes one female nub disposed along its inner edge and engaging said one male nub.

16. A method of making an arc stack for receiving a circuit breaker blade moveable between a closed position and an open position, the method comprising the steps of:

stamping out a plurality of arc plates;

arranging the arc plates substantially parallel to one another to form a generally rectangular body and in groups including one or more of said arc plates having substantially similar respective arc throats formed therein, said respective arc throats progressively decreasing in depth from group to group along the length of the arc stack in a direction extending away from the closed position of the blade so as to form a curved passageway extending through the arc throats following the radius of the blade moving between the closed and open positions, said arc throats extending inwardly from respective arc-throat forming edges of said arc plates, said respective arc-throat forming edges being substantially coplanar with each other; and maintaining the arc plates substantially parallel to one another using a connecting support.

* * * * *